US009460657B2

(12) United States Patent
Pyo

(10) Patent No.: US 9,460,657 B2
(45) Date of Patent: Oct. 4, 2016

(54) DISPLAY DEVICE AND METHOD OF DRIVING THE SAME

(71) Applicant: Si-Baek Pyo, Yongin (KR)

(72) Inventor: Si-Baek Pyo, Yongin (KR)

(73) Assignee: SAMSUNG DISPLAY CO., LTD., Yongin, Gyunggi-do (KR)

( * ) Notice: Subject to any disclaimer, the term of this patent is extended or adjusted under 35 U.S.C. 154(b) by 243 days.

(21) Appl. No.: 13/792,857

(22) Filed: Mar. 11, 2013

(65) Prior Publication Data

US 2014/0125714 A1 May 8, 2014

(30) Foreign Application Priority Data

Nov. 6, 2012 (KR) ..... 10-2012-0125093

(51) Int. Cl.
*G09G 3/3208* (2016.01)
*G09G 3/32* (2016.01)

(52) U.S. Cl.
CPC .... *G09G 3/3233* (2013.01); *G09G 2300/0819* (2013.01); *G09G 2300/0861* (2013.01); *G09G 2310/0262* (2013.01); *G09G 2320/043* (2013.01); *G09G 2320/064* (2013.01); *G09G 2320/0673* (2013.01)

(58) Field of Classification Search
CPC ..... G09G 3/3208; G09G 3/3233; G09G 2320/043; G09G 2300/0819; G09G 2320/064; G09G 2300/0861
USPC ..... 345/690–697, 208–215, 39, 44–47, 345/76–83; 313/384–390
See application file for complete search history.

(56) References Cited

U.S. PATENT DOCUMENTS 7,286,104 B2 * 10/2007 Sempel ..... G09G 3/20 345/77
8,194,028 B2 * 6/2012 Fletcher ..... G09G 3/3406 345/102
2005/0057580 A1 * 3/2005 Yamano ..... G09G 3/3241 345/690
2005/0168491 A1 * 8/2005 Takahara ..... G09G 3/006 345/690
2006/0164345 A1 7/2006 Sarma et al.
2007/0080905 A1 * 4/2007 Takahara ..... G09G 3/3233 345/76
2007/0139310 A1 * 6/2007 Kang ..... G09G 3/22 345/76
2008/0238953 A1 * 10/2008 Ogura ..... G09G 3/3275 345/697
2008/0284768 A1 * 11/2008 Yoshida ..... G09G 3/2022 345/208
2009/0267973 A1 * 10/2009 Lee ..... G09G 3/2011 345/690
2009/0322724 A1 * 12/2009 Smith ..... G09G 3/2022 345/211

(Continued)

FOREIGN PATENT DOCUMENTS

KR 10-2007-0024143 3/2007
KR 10-2011-0032245 3/2011

(Continued)

*Primary Examiner* — Kumar Patel
*Assistant Examiner* — Vinh Lam
(74) *Attorney, Agent, or Firm* — Lee & Morse, P.C.

(57) ABSTRACT

A display device includes a pixel unit including a plurality of pixels that have light-emitting time periods adjusted in response to light-emitting control signals, and a brightness control unit that adjusts a duty ratio of the light-emitting control signals and setting gamma and that converts image data according to a brightness mode.

19 Claims, 7 Drawing Sheets

(56) References Cited

U.S. PATENT DOCUMENTS

2010/0033513 A1* 2/2010 Choi ..... G09G 3/3406 345/690
2010/0039454 A1* 2/2010 Nakamura ..... G09G 3/3233 345/690
2010/0045690 A1* 2/2010 Handschy ..... G09G 3/3629 345/549
2010/0053233 A1* 3/2010 Ishiguro ..... G09G 3/3233 345/690
2010/0073406 A1* 3/2010 Shishido ..... G09G 3/2033 345/691
2010/0079507 A1* 4/2010 Yatabe ..... G09G 3/3233 345/691
2010/0225634 A1* 9/2010 Levey ..... G09G 3/3208 345/212
2010/0265277 A1* 10/2010 Takahara ..... G09G 3/2014 345/690
2011/0069098 A1 3/2011 Lee et al.
2011/0298837 A1* 12/2011 Holub ..... G09F 3/14 345/690
2011/0316893 A1 12/2011 Lee et al.
2012/0062613 A1 3/2012 Park et al.
2012/0313923 A1* 12/2012 Minami ..... G09G 3/3233 345/212
2013/0063498 A1* 3/2013 Yabukane ..... G09G 3/3225 345/690
2013/0083083 A1* 4/2013 Woo ..... G09G 3/3208 345/690
2013/0093800 A1* 4/2013 Shim ..... G09G 3/3233 345/690
2013/0100173 A1* 4/2013 Chaji ..... G09G 5/10 345/690
2013/0127924 A1* 5/2013 Lee ..... G09G 3/32 345/690
2013/0127931 A1* 5/2013 Shioya ..... G03B 21/14 345/690
2013/0201223 A1* 8/2013 Li ..... G09G 3/2022 345/690
2013/0321485 A1* 12/2013 Eom ..... G09G 3/3208 345/690
2015/0130857 A1* 5/2015 Yoshida ..... G09G 3/3406 345/690

FOREIGN PATENT DOCUMENTS

KR 10-2011-0058352 A 6/2011
KR 10-1093265 12/2011
KR 10-2012-0028426 3/2012

* cited by examiner

DISPLAY DEVICE AND METHOD OF DRIVING THE SAME

CROSS-REFERENCE TO RELATED PATENT APPLICATION

This application claims priority under 35 U.S.C. §119 to Korean Patent Application No. 10-2012-0125093, filed on Nov. 6, 2012, in the Korean Intellectual Property Office, the disclosure of which is incorporated herein in its entirety by reference.

BACKGROUND

Organic light emitting diodes that are used for organic electroluminescence display devices are self light emitting diodes where a light emitting layer is formed between two electrodes.

SUMMARY

Embodiments may be realized by providing a display device that includes a pixel unit having a plurality of pixels whose light-emitting time periods are adjusted in response to light-emitting control signals, and a brightness control unit adjusting the duty ratio of the light-emitting control signals and setting gamma and converts image data according to a brightness mode.

The brightness control unit may adjust the setting gamma to allow the gamma of images displayed on the pixel unit to be constant regardless of changes in the duty ratio of the light-emitting control signals. The brightness control unit may set reference brightness serving as reference for converting brightness, select the duty ratio of the light-emitting control signals and the setting gamma according to the brightness mode, and convert the image data to allow gradation voltages according to the reference brightness and setting gamma to be output.

As the brightness mode has lower brightness, the brightness control unit may increase the off-periods of the light-emitting control signals that turn off the plurality of pixels. The brightness control unit may vary the setting gamma according to the brightness mode or the duty ratio of the light-emitting control signals.

As the brightness mode has lower brightness or the off-periods of the light-emitting control signals gets longer, the brightness control unit may decrease the value of the gamma setting. The brightness control unit may include a duty ratio setting unit adjusting and outputting the duty ratio of the light-emitting control signals, a gamma setting unit selecting the setting gamma in response to the brightness mode or the light-emitting control signals, and a data converting unit converting the image data according to the brightness mode.

The gamma setting unit may include a brightness-gamma lookup table in which the values of the setting gamma are mapped according to brightness, or a gamma function setting unit in which a gamma function is set to calculate the values of the setting gamma according to brightness.

The data converting unit may include a reference gradation lookup table in which reference gradation by brightness is mapped on the basis of maximum brightness and given gamma, and convert the image data with reference to the reference brightness and the reference gradation corresponding to brightness by gradation according to the setting gamma. The plurality of pixels may include organic electroluminescence diodes.

Embodiments may also be realized by providing an organic electroluminescence display device that includes a pixel unit having a plurality of pixels, a data driver supplying data signals to the pixel unit, a scan driver supplying scan signals and light-emitting control signals to the pixel unit, and a timing controller including a brightness control unit to adjust the duty ratio of the light-emitting control signals and setting gamma according to a brightness mode and convert image data and providing control signals to the data driver and the scan driver.

The brightness control unit may set reference brightness and the duty ratio of the light-emitting control signals according to the brightness mode and adjust the setting gamma to allow the gamma of images displayed on the pixel unit to be constant regardless of changes in the duty ratio of the light-emitting control signals. The timing controller and the data driver may be integrated on single semiconductor chip.

Embodiments may also be realized by providing a method of driving a display device for driving a pixel unit that includes a plurality of pixels that may include setting reference brightness according to a brightness mode, adjusting the duty ratio of light-emitting control signals according to the brightness mode, adjusting setting gamma according to the brightness mode or the duty ratio of the light-emitting control signals, converting image data according to the reference brightness and the setting gamma, and driving the pixel unit in response to the converted image data and the light-emitting control signals.

The setting gamma may be adjusted to allow the gamma of images displayed on the pixel unit to be constant regardless of changes in the duty ratio of the light-emitting control signals. The adjusting of the duty ratio of the light-emitting control signals may be set to allow the off-periods of the light-emitting control signals turning off the plurality of pixels to increase, as the brightness mode has lower brightness.

The adjusting of gamma setting may be set to allow the value of the gamma setting to decrease, as the brightness mode has lower brightness or the off-periods of the light-emitting control signals increase. The adjusting of setting gamma may include setting the setting gamma with reference to a lookup table in which the values of setting gamma is mapped according to brightness considering the properties of the pixel unit.

The converting of image data may include selecting reference gradation corresponding to the brightness mode and brightness by gradation according to the setting gamma with reference to a reference gradation lookup table in which reference gradation by brightness is mapped on the basis of maximum brightness and given gamma, and converting the image data with reference to the selected reference gradation.

BRIEF DESCRIPTION OF THE DRAWINGS

Features will become more apparent by describing in detail exemplary embodiments thereof with reference to the attached drawings in which.

DETAILED DESCRIPTION

Figure 1:
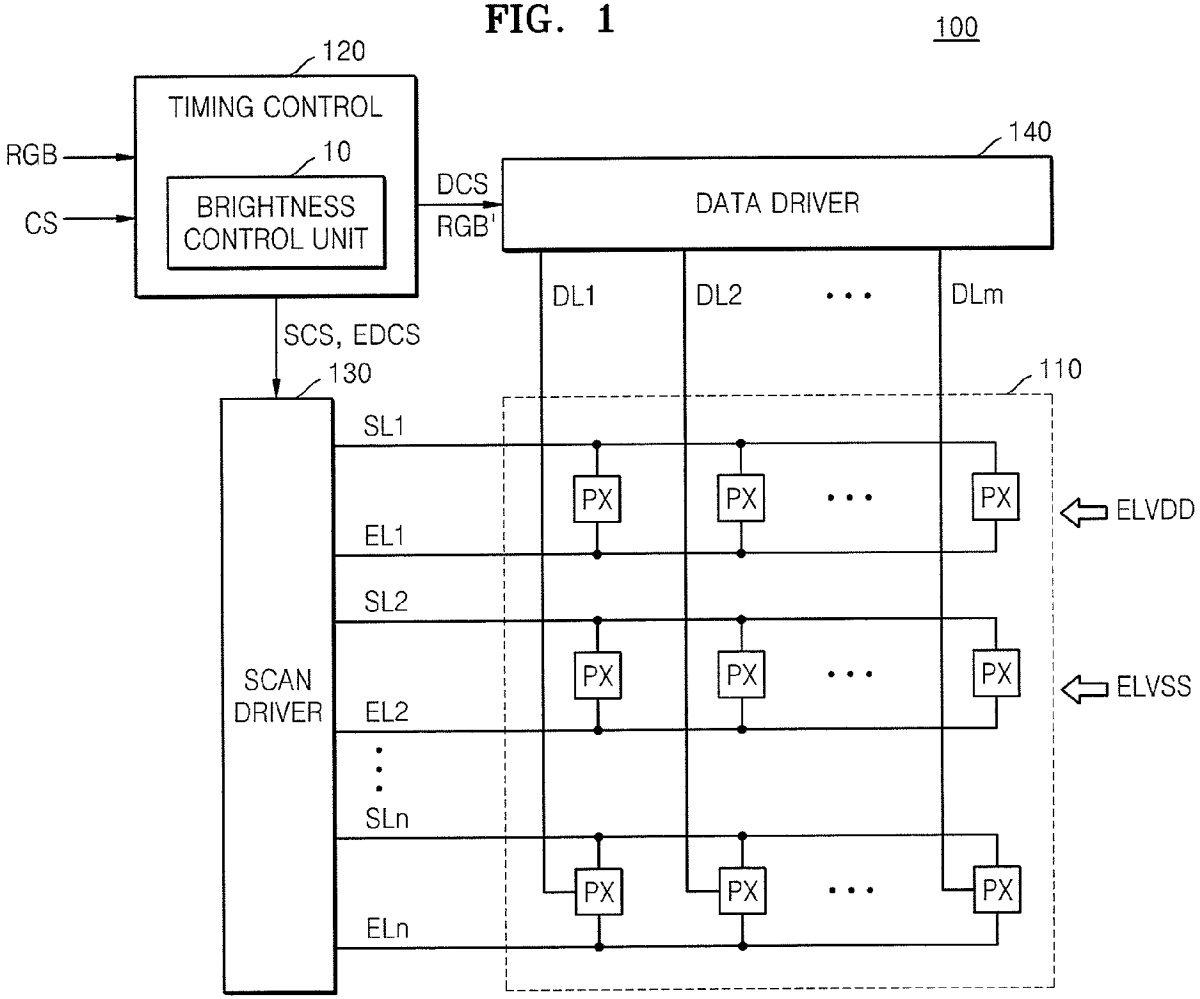
FIG. 1 is a view schematically illustrating a display device according to an embodiment.

Embodiments will now be described more fully with reference to the accompanying drawings, in which exemplary embodiments are shown. Exemplary embodiments are provided so that this disclosure will be thorough and complete, and will fully convey the concept of the embodiments to those skilled in the art. As the embodiments may make various changes and have various forms, it is intended to illustrate specific embodiments in the drawings and describe them in detail. However, it should be understood that this is intended not to limit the embodiments to specific disclosed forms but to include all changes, equivalents and replacements that fall within the spirit and technical scope. Like reference signs are used for like components in describing each drawing. In the accompanying drawings, the dimension of structures is illustrated to be larger or smaller than an actual dimension for the clarity.

The terms used herein are just for describing specific embodiments and are not intended to limit the embodiments. The terms of a singular form may include plural forms unless clearly otherwise referred to in context. In this application, it should be understood that the term "include," "comprise," "have", "including," "comprising,", or "having" is intended to specify that there are features, figures, steps, operations, components, parts or their combinations represented in the specification and not to exclude that there may be one or more other features, figures, steps, operations, components, parts, or their combinations or that they may be added.

In addition, though terms like a first and a second are used to describe various components, the components should not be limited by the terms. The terms may be used for the purpose of distinguishing one component from another. For example, a first component may be named a second component and similarly, a second component may be named a first component without departing from the scope of the embodiments.

Unless being otherwise defined, all terms used herein that include technical or scientific terms have the same meaning as those generally understood by those skilled in the art. The terms, such as those defined in dictionaries generally used should be construed to have meaning matching that having in context of the related art and are not construed as ideal or excessively perfunctory meaning unless being clearly defined in this application.

FIG. 1 is a view schematically illustrating a display device according to an embodiment.

Referring to FIG. 1, a display device according to one embodiment includes a pixel unit 110, a timing controller 120, a scan driver 130, and a data driver 140. Each of the timing controller 120, the scan driver 130, and the data driver 140 may be made on a separate semiconductor chip or they may be integrated on one semiconductor chip. In addition, the scan driver 130 may be made on the same substrate as the pixel unit 110.

The pixel unit 110 includes a plurality of pixels PX that are arranged at the intersections of scan lines SL1 to SLn arranged in rows and data lines DL1 to DLm arranged in columns in a matrix manner. The pixels PX receives scan signals and data signals from the scan lines SL1 to SLn and the data lines DL1 to DLn, respectively. In addition, it receives light-emitting control signals from light-emitting control signal lines Elm. The pixels emit light according to the scan signals, data signals, light-emitting control signals, and pixel power supplies ELVDD and ELVSS to display pictures. The light-emitting time period of the pixels PX may be adjusted in response to light-emitting control signals.

FIG. 1 illustrates a case in which the pixel unit 110 is an organic electroluminescence panel including pixels PX that include organic light emitting diodes. However, embodiments are not limited thereto, e.g., the pixel unit 110 may include pixels that include other kinds of light emitting elements.

The scan driver 130 receives scan control signals SCS and light-emitting duty control signals EDCS from the timing controller 120 and creates scan signals and light-emitting control signal. At this point, the duty ratio of the light-emitting control signals is adjusted in response to the light-emitting duty control signals EDCS.

For example, the scan driver 130 may supply the created scan signals and light-emitting control signals through the scan lines SL1 to SLn and the light-emitting control signal lines EL1 to ELn, respectively, to the pixels PX. Pixels PX may be sequentially selected row by row according to the scan signals and the data signals may be provided. The light-emitting time periods of the pixels PX may be adjusted according to the light-emitting control signals. Although this embodiment illustrates that the scan signals and light-emitting control signals are created at the same scan driver 130, the display device 100 may further include a light-emitting control driving unit, and the light-emitting control signals may be created at the light-emitting control driving unit.

The data driver 140 receives data control signals and image data RGB' from the timing controller 120, responds to the data control signals, and supplies data signals corresponding to the image data RGB' through the data lines DL1 to DLm to the pixels PX. The data driver 140 converts the received image data RGB' to data signals in the form of voltage or current.

The timing controller 120 creates signals SCS, EDCS, and DCS for controlling the scan driver 130 and the data driver 140 based on the image signals and the control signals transmitted from the outside and provides them to the scan driver 130 and the data driver 140. The control signals may be, e.g., timing signals, such as vertical sync signals Vsync, horizontal sync signals Hsync, clock signals CLK, and data enable signals DE, or a signal for setting a brightness mode. The timing controller 120 converts the image signals RGB received from the outside and provides them to the data driver 130. The timing controller 120 may include a graphic RAM GRAM (not illustrated) and may temporarily store a frame of image signals RGB in the graphic RAM that have been received from the outside.

The timing controller 120 may include a brightness control unit 10. The brightness control unit 10 may convert the image data RGB or adjust the duty ratio of the light-emitting control signals according to a brightness mode to adjust the light-emitting brightness of the pixel unit 110.

Techniques of adjusting brightness through image data conversion and the duty-ratio adjustment of the light-emitting control signals will be described in detail below with reference to FIGS. 2 and 3.

Figure 2:
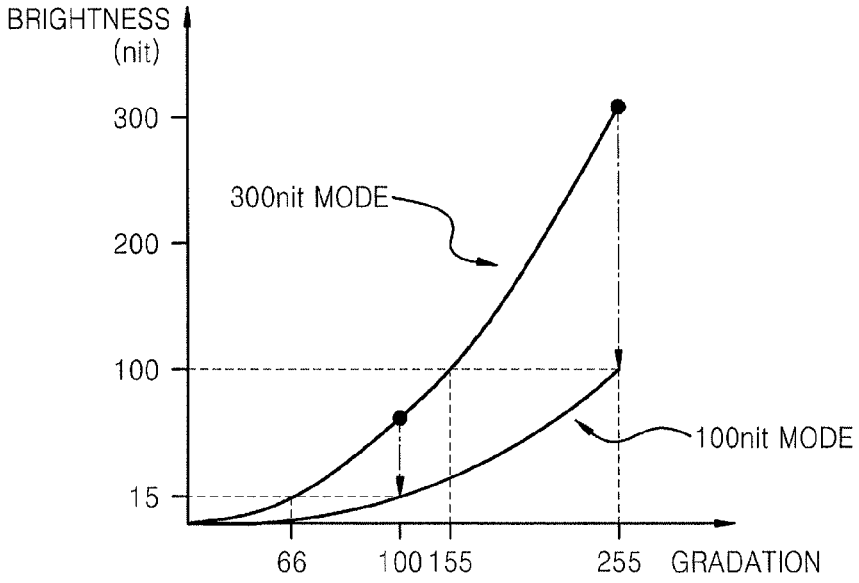
FIG. 2 is a view depicting brightness adjustment through image data conversion.

FIG. 2 is a view depicting brightness adjustment through image data conversion. In the technique of adjusting brightness by converting image data, gradations by brightness in the maximum brightness mode are set as a reference gradation for each brightness, when the brightness mode has been changed. Then, a reference gradation is selected, which corresponds to the brightness of gradations that image data represents in the brightness mode, and image data is converted according to the reference gradation. Brightness may be measured as luminance using a unit of $cd/m^2$, i.e., nit.

Referring to FIG. 2, brightness changes so that the maximum gradation becomes 100 nit (referred to hereinafter as 100 nit mode), based on when the brightness of the maximum gradation 255 is 300 nit (referred to hereinafter as 300 nit mode). Gradations by brightness when in a 300 nit mode are set as reference gradations. If image data represents '255' gradation in a 100 nit mode, then the gradation brightness at '255' gradation should become 100 nit. A reference gradation corresponding to brightness of 100 nit is '155' gradation. Thus, image data illustrating '255' gradation is converted to image data illustrating '155' gradation.

For example, if image data is an 8-bit digital signal, then a signal '11111111' representing '255' gradation is converted to '10011011' representing '155' gradation. As another example, if image data represents '100' gradation in a brightness mode of 100 nit, then gradation brightness at '100' gradation should become 15 nit. Since a reference gradation corresponding to 15 nit, image data representing '100' gradation is converted to image data representing '66' gradation. As described above, a change to the 100 nit mode may be made only by converting image data without changing the setting of the display device 100 (e.g., voltage by gradation) set to be in the 300 nit mode.

Figure 3:
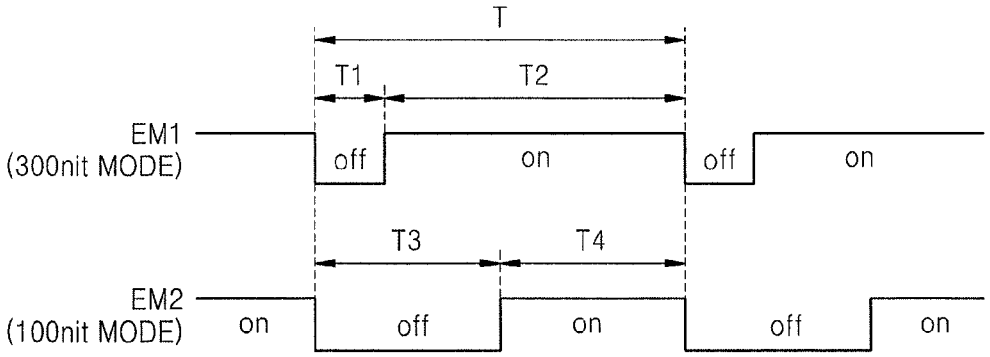
FIG. 3 is a view depicting brightness adjustment through the duty ratio adjustment of light-emitting control signals.

FIG. 3 is a view depicting brightness adjustment through the duty ratio adjustment of light-emitting control signals. According to the technique of adjusting the duty ratio of light-emitting control signals, on-periods or off-periods for a cycle (e.g., a frame) of a light-emitting control signal controlling the turn-on and turn-off of the pixels PX may be varied to change brightness. Referring to FIG. 3, the on-period T2 of a light-emitting control signal EM2 in the 100 nit mode is shorter than the on-period T4 of a light-emitting control signal EM1 in the 300 nit mode. Further, the off-period T3 of the light-emitting control signal EM2 is longer than the off-period T1 in the 300 nit mode.

If the pixels turn-on for the on-periods of the light-emitting control signal and turn-off for the off-periods thereof, then brightness may become lower as the on-periods of the light-emitting control signals decrease or the off-periods of the light-emitting control signals increase. At this point, the duty ratio of the on/off periods of the light-emitting control signals EM1 and EM2 according to the brightness mode may be set considering the unique properties of the pixel unit 110.

Referring back to FIG. 1, the brightness control unit 10 may set a desired brightness mode by combining the techniques of converting image data and adjusting the duty ratio of light-emitting control signals. For example, in case of a low-gradation mode, if the combining technique is used, then better picture quality may be present compared to using a technique of converting image data or adjusting the duty ratio of light-emitting control signals to adjust brightness.

The brightness control unit 10 may set reference brightness according to a brightness mode, adjust the duty ratio of light-emitting control signals and setting gamma, and convert image data according to the reference brightness and setting gamma. For example, in a low-gradation mode below 110 nit, a control may be made so that the brightness of the pixel unit 110 corresponds to a brightness mode by setting the reference brightness to 110 nit and adjusting the duty ratio of the off-periods of the light-emitting control signals.

If the brightness mode is the 100 nit mode, then the reference brightness may be set to 110 nit and the duty ratio of the off-periods of the light-emitting control signals may be set to 10% so that the brightness of images displayed on the pixel unit 110 becomes 100 nit. If the brightness mode is a 90 nit mode, then the reference brightness may be set to 110 nit and the duty ratio of the off-periods of the light-emitting control signals may be set to 20% so that the brightness of images displayed on the pixel unit 110 becomes 80 nit. As such, the reference brightness may be equally set and the duty ratio of the off-periods of the light-emitting control signals may increase so that brightness decreases.

At this point, image data is converted assuming that the brightness mode is a reference mode, e.g., the 110 nit mode. Although the image data is converted in line with a case in which the brightness mode is the 110 nit mode, reference brightness, the brightness of images displayed on the pixel unit 110 may decrease according to a brightness mode as the duty ratio of the off-periods of the light-emitting control signals increases.

The brightness control unit 10 may adjust setting gamma so that the gamma of images displayed on the pixel unit is constant regardless of the duty ratio of the light-emitting control signals. If adjusting the duty ratio of the light-emitting control signals to change brightness, a phenomenon may occur that a gamma value increases by a loading effect, as the duty ratio of the off-periods of the light-emitting control signals, namely the off-periods of the light-emitting control signals gets longer. Even if setting gamma is equal, the value of the gamma of images displayed on the pixel unit, for example measuring gamma may vary depending on the duty ratio of on/off periods of the light-emitting control signals. Thus, a variation in the value of measuring gamma may be prevented through gamma compensation that adjusts setting gamma according to a brightness mode or the duty ratio of the light-emitting control signals.

Gradation brightness and gamma may be expressed as follows.

$$BR_{Gn}=BR_G*(Gn/G)\hat{}\gamma \quad \text{<Equation 1>}$$

$$\gamma=\log(BR_{Gn}/BR_G)/\log(Gn/G) \quad \text{<Equation 2>}$$

At this point, $BR_{Gn}$, $BR_G$, Gn, G, and $\gamma$ represent brightness of each gradation, brightness of maximum gradation, gradations, maximum gradation, and gamma, respectively.

According to Equations above, the larger gamma is, the lower gradation brightness in middle gradations is. The smaller gamma is, the higher gradation brightness in middle gradations is. What measuring gamma is larger than setting gamma means that gradation brightness is lower than a calculated gradation brightness. What measuring gamma is smaller than setting gamma means that gradation brightness is higher than a calculated gradation brightness. Thus, an adjustment may be made by varying setting gamma and making the gradation brightness of middle gradations higher or lower so that measuring gamma becomes a desired gamma value.

As described above, the display device 100 a may easily change brightness according to a brightness mode through data conversion and the duty-ratio adjustment of light-emitting control signals, and at this point, by varying setting gamma, a control may be made so that measuring gamma is equal regardless of the duty ratio of light-emitting control signals.

Figure 4:
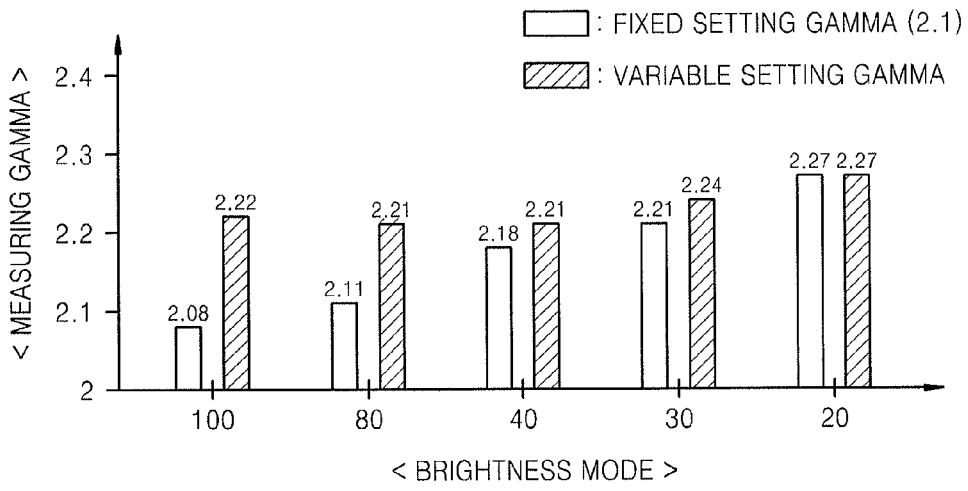
FIG. 4 is a view illustrating measuring gamma according to setting gamma.

FIG. 4 is a view illustrating measuring gamma according to setting gamma settings.

Measuring gamma is illustrated where after brightness and gamma are set to 300 nit and 2.2, respectively in the display device 100 of FIG. 1, reference brightness is set to 110 nit to change to a low brightness mode, the duty ratio of light-emitting control signals is varied according to a brightness mode, and setting gamma is set as in Table 1.

TABLE 1

| Brightness Mode | Setting Gamma | |
|---|---|---|
| (nit) | Fixed | Variable |
| 100 | 2.1 | 2.25 |
| 90 | | 2.24 |
| 80 | | 2.23 |
| 70 | | 2.22 |
| 60 | | 2.20 |
| 50 | | 2.18 |
| 40 | | 2.15 |
| 30 | | 2.13 |
| 20 | | 2.10 |

Referring to FIG. 4, it may be seen that if setting gamma is fixed to 2.1, then the lower a brightness mode gets, the larger the value of measuring gamma is. Even if gamma is set to 2.1, the value of measuring gamma significantly increases as the duty ratio of light-emitting control signals varies depending on a brightness mode. However, as setting gamma varies depending on a brightness mode according to embodiments, gamma is relatively evenly distributed near 2.2.

Referring to when setting gamma is fixed to 2.1 in Table 1, as a brightness mode gets lower, namely as the off-periods of light-emitting control signals increase, the value of measuring gamma gets larger. Thus, the brightness control unit (10 in FIG. 1) may compensate gamma by decreasing the value of setting gamma as a brightness mode gets lower, namely as the off-periods of light-emitting control signals increase. At this point, the value of setting gamma that varies may vary depending on the unique properties of the pixel unit (110 in FIG. 1). The value of setting gamma may be set according to a brightness mode considering the unique properties of the pixel unit 110 measured in the step of manufacturing the display device 100.

Figure 5:
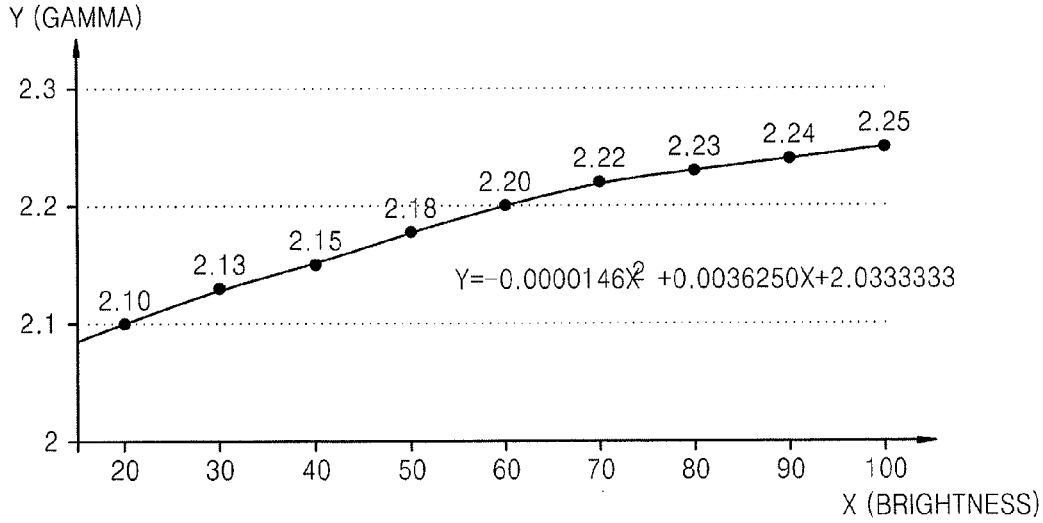
FIG. 5 is a view illustrating a relation between a brightness mode and setting gamma.

FIG. 5 is a view illustrating a relation between a brightness mode and setting gamma. In particular, this figure illustrates a graph and a function between a brightness mode and setting gamma based on the variable value of setting gamma according to the brightness mode in Table 1.

If the value of setting gamma is determined at a given brightness interval as in Table 1, e.g., at 10 nit, then a relation between the brightness mod and setting gamma may be derived as a gamma function as illustrated in FIG. 5, and the gamma function may be stored in the brightness control unit 10 in FIG. 1. The brightness control unit 10 includes a gamma function, therefore the value of setting gamma may be determined by using the function if a brightness mode is not, e.g., 100 nit, 90 nit in which the value of the setting gamma has been determined but another brightness mode, e.g., a 82 nit mode.

Figure 6A:
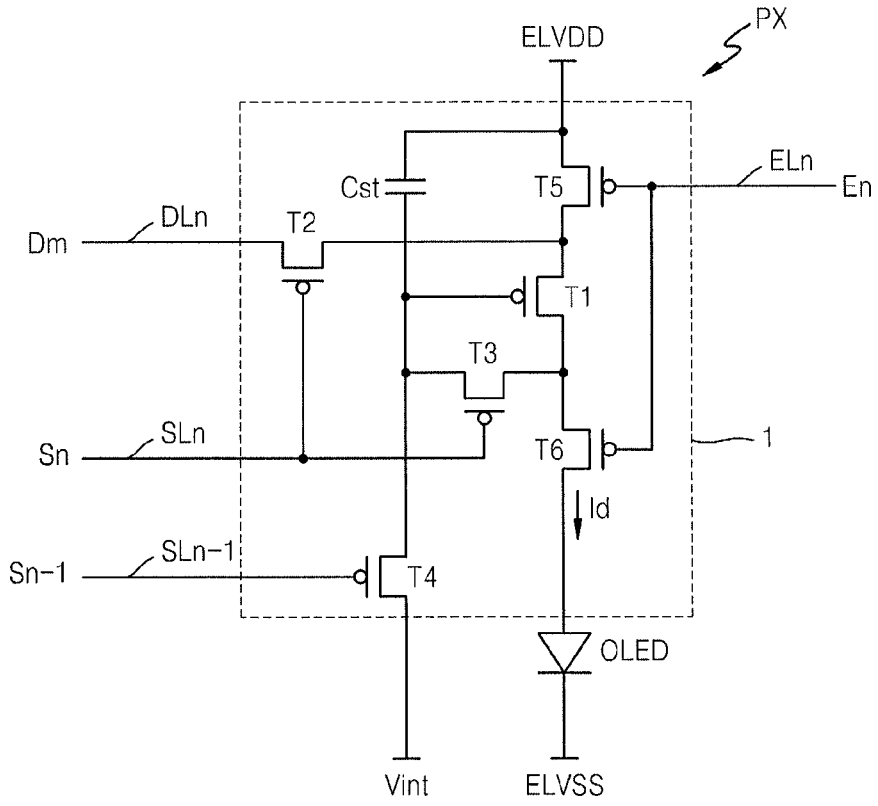
FIG. 6A is a view illustratively representing a pixel illustrated in FIG. 1.
Figure 6B:
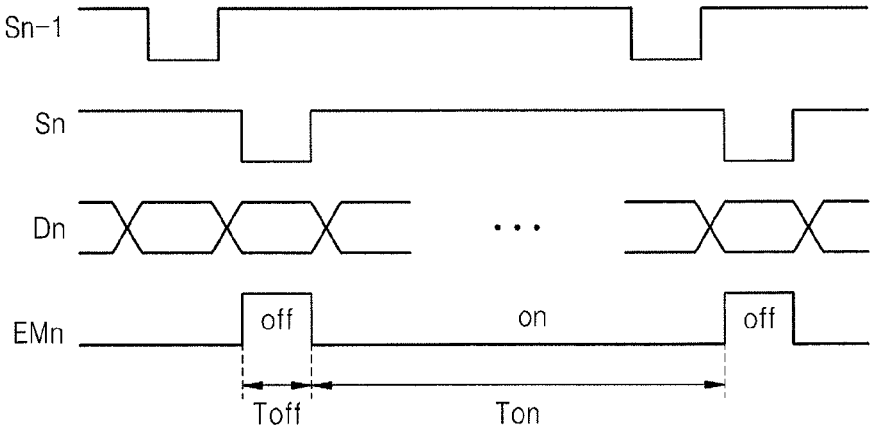
FIG. 6B is a driving waveform diagram of the pixel illustrated in FIG. 6A.

FIG. 6A is a circuit diagram illustratively representing a pixel illustrated in FIG. 1, and FIG. 6B is a driving waveform diagram of the pixel PX illustrated in FIG. 6A.

Referring to FIGS. 6A and 6B, the pixels PX include a light emitting element OLED and a pixel circuit 1 that includes transistors T1 to T6 and a capacitor Cst.

The pixel circuit 1 may receive scan signals Sn and Sn-1, a data signal Dm, and a light-emitting control signal and may drive the light emitting element OLED at the timing set and during a set period. The transistors T1 to T6 may be thin film transistors TFTs. Although the transistors T1 to T6 are illustrated as, e.g., P-type transistors, they may be N-type transistors and the driving waveforms in FIG. 6B may be reversely driven. In addition, although this embodiment illustrates that the pixel circuit 1 includes six transistors T1 to T6 and one capacitor Cst, it is not limited thereto. The numbers of the transistors and capacitors that make up the pixel circuit 1 may be various.

The light emitting element receives a driving voltage through the pixel circuit 1 and emits light by itself. For example, the light emitting element OLED may be an organic light emitting diode (OLED).

A low-level previous scan signal Sn-1 is supplied through a previous scan line SLn-1 while initializing. An initialization transistor T4 turns on in response to the low-level previous scan signal Sn-1, an initialization voltage Vint is coupled to the gate electrode of a driving transistor T1 through an initialization transistor T4, and the driving transistor T1 is initialized by the initialization voltage Vint.

Subsequently, a low-level scan signal Sn is supplied through the scan line SLn while programming data. Then, a switching transistor T2 and a compensation transistor T3 turn on in response to the low-level scan signal Sn. At this point, the driving transistor T1 is coupled to a diode by the compensation transistor T3 turned on and is forward-biased.

Then, a compensation voltage Dm+Vth (where, Vth has a negative value) obtained by subtracting the threshold voltage Vth of the driving transistor T1 from the data signal Dm supplied from the data line DLm is applied to the gate electrode of the driving transistor T1.

A driving voltage ELVDD and the compensation voltage Dm+Vth are applied to both ends of the capacitor Cst, and charges corresponding to a voltage difference between both ends are stored in the capacitor Cst. Subsequently, a light emitting signal EMn supplied from a light emitting signal line is changed from a high level to a low level during a turn-on period Ton. Then, an operation control transistor T5 and a light-emitting control transistor T6 turn on by a low-level light emitting signal EMn during the turn-on period Ton.

Then, a driving current Id generates by a voltage difference between the voltage of the gate electrode of the driving transistor T1 and the voltage of the driving voltage ELVDD and the driving current is supplied to the organic light emitting diode (OLED) through the light-emitting control transistor T6.

The gate-source voltage Vgs of the driving transistor T1 of the gate electrode of a storage capacitor Cst is kept at (Dm+Vth)−ELVDD during a light emitting period. According to the current-voltage relation of the driving transistor T1, the driving current may be proportional to the square of a value obtained by subtracting a threshold voltage from a gate-source voltage $(Dm-ELVDD)^2$. That is, the light emitting brightness of the organic light emitting diode (OLED) may be controlled according to the data signal Dm.

Light emitting brightness may be controlled according to the duty ratio of the turn-on period Ton or the duty ratio of the turn-off period Toff of the organic light emitting diode (OLED) by the light-emitting control signal EMn. Even if the same data signal is applied, the higher the duty ratio of a turn-on period Ton for a cycle including a turn-on period Ton and a turn-off period Toff, e.g., a display period of a frame, is the higher the light emitting brightness of the organic light emitting diode (OLED) is. Further, the higher the duty ratio of a turn-off period Toff for a display period of a frame is, the lower the light emitting brightness of the organic light emitting diode (OLED) gets. Thus, the light emitting brightness of the organic light emitting diode (OLED) may be controlled according to the data signal Dm and the light-emitting control signal EMn.

Figure 7:
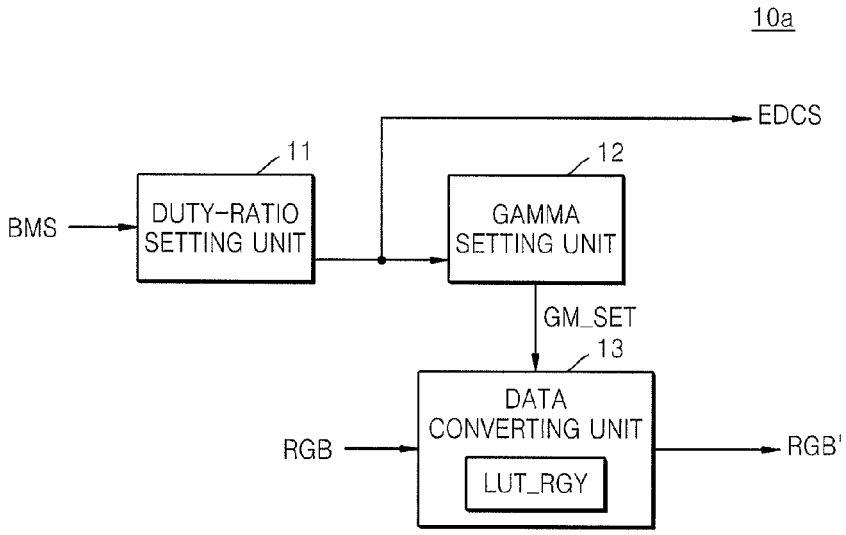
FIG. 7 is a block diagram representing an implementation of the brightness control unit of FIG. 1.

FIG. 7 is a block diagram representing an implementation of the brightness control unit of FIG. 1.

Referring to FIG. 7, the brightness control unit 10*a* may include a duty ratio setting unit 11, a gamma setting unit 12, and a data converting unit 13. The brightness control unit 10*a* creates a light-emitting duty control signal EDCS in response to a brightness mode based on given reference brightness. Further, the brightness control unit 10*a* may convert image data RGB and provide the converted image data RGB' to the data driver 140.

The duty ratio setting unit 11 may receive a brightness mode signal BMS representing a brightness mode. The duty ratio setting unit 11 may create and output a light-emitting duty control signal EDCS for adjusting the duty ratio of a light-emitting control signal based on the brightness mode signal BMS. The light-emitting duty control signal EDCS may set the duty ratio of the off-period or on-period of the light-emitting control signal to 10% to 90%.

The gamma setting unit 12 may select setting gamma GM_SET in response to the light-emitting duty control signal EDCS or in response to the brightness mode. The gamma setting unit 12 may include a lookup table in which the values of setting gamma according to the brightness mode have been mapped and may reference the lookup table to select setting gamma. According to another exemplary embodiment, the gamma setting unit 12 may include a gamma function setting unit in which a gamma function described with reference to FIG. 5 has been set and may calculate setting gamma according to the brightness mode by using the gamma function.

The data converting unit 13 may create and output converted image data RGB' obtained by converting image data RGB according to the brightness mode. The data converting unit 13 may include a reference gradation lookup table LUT_RGY in which reference gradations by brightness have been mapped based on given brightness and gamma. The given brightness may be maximum brightness or initial brightness that has been set prior to changing brightness. For example, the given brightness may be 300 nit and the gamma may be 2.2. The gamma setting unit 12 may calculate brightness by gradation according to reference brightness and setting gamma, and may select a reference gradation corresponding to the calculated brightness, from the reference gradation lookup table LUT_RGY. Then, image data RBG may be changed to image data RGB' representing the reference gradation.

Figure 8:
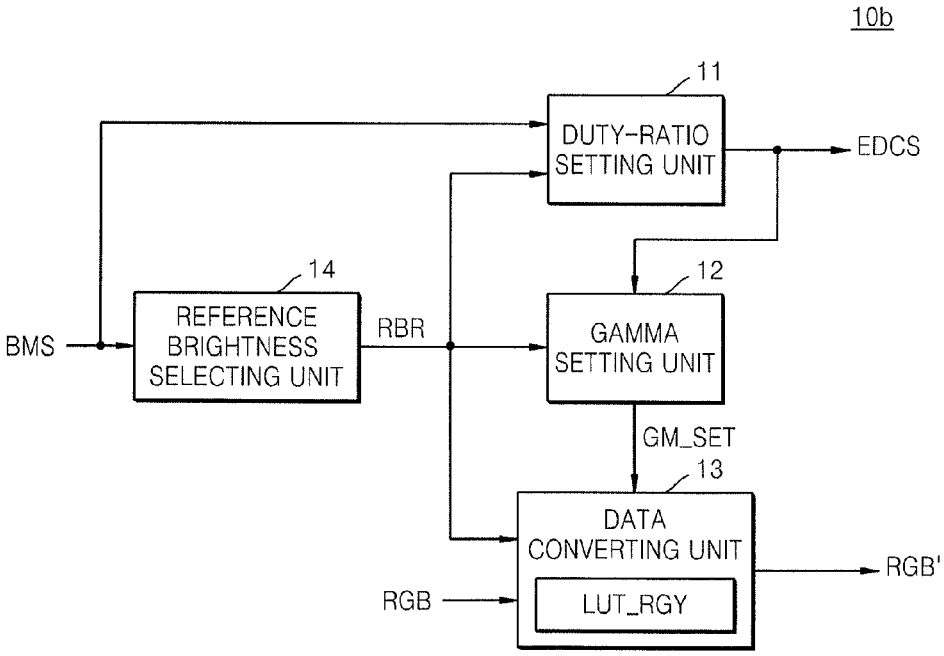
FIG. 8 is a block diagram representing another implementation of the brightness control unit of FIG. 1.

FIG. 8 is a block diagram representing another implementation of the brightness control unit of FIG. 1.

Referring to FIG. 8, the brightness control unit 10*b* may include a duty ratio setting unit, a gamma setting unit 12, a data converting unit, and a reference brightness selecting unit 14.

The reference brightness selecting unit 14 may select reference brightness in response to a brightness mode signal representing a brightness mode. For example, 220 nit may be selected as reference brightness if the brightness mode is less than or equal to 220 nit and greater than 110 nit, and 110 nit may be selected as reference brightness if the brightness mode is less than or equal to 110 nit and greater than or equal to 10 nit.

The duty ratio setting unit 11, the gamma setting unit 12, and the data converting unit 13 may operate in response to reference brightness RBR output from the reference brightness selecting unit 14. The duty ratio setting unit may output a light-emitting duty control signal EDCS in response to the reference brightness RBR and the brightness mode signal BMS. The gamma setting unit 12 may select setting gamma GM_SET in response to the reference brightness RBR and the light-emitting duty control signal EDCS. The data converting unit 13 may convert image data RGB considering the reference brightness RBR when converting image data. Other operations are similar to those in FIG. 7, therefore their detailed description will not be provided.

Figure 9:
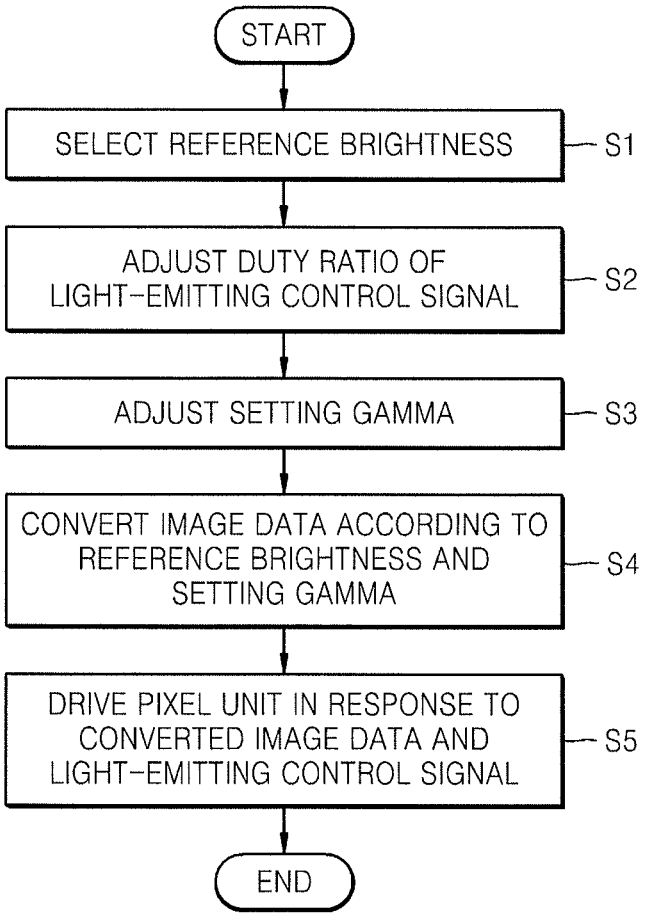
FIG. 9 is a flow chart schematically depicting a method of driving a display device according to an embodiment.

FIG. 9 is a flow chart schematically depicting a method of driving a display device according to an embodiment.

Referring to FIG. 9, the brightness control unit (10 in FIG. 1) of a display device (100 in FIG. 1) selects reference brightness according to a brightness mode in operation S1. Brightness modes with similar brightness values at a given brightness interval may select the same reference brightness. According to another exemplary embodiment, single reference brightness may be selected regardless of the brightness modes.

Next, the duty ratio of a light-emitting control signal is adjusted according to a brightness mode in operation S2. The duty ratio setting unit 11 included in the brightness control unit (10 in FIG. 1) may adjust the duty ratio of the light-emitting control signal in response to the brightness mode or the brightness mode and the reference brightness. The duty ratio setting unit 11 may select and output a light-emitting duty control signal to a scan driver (130 in FIG. 1) to adjust the duty ratio of the light-emitting control signal.

Then, setting gamma is adjusted according to the brightness mode or the duty ratio of the light-emitting control signal in operation S3. As the brightness mode has lower brightness or the off period of the light-emitting control signal increases, the values of setting gamma may decrease.

If setting gamma is selected in operation S3, then image data is converted according to reference brightness and setting gamma in operation S4. Brightness by gradation is calculated according to the reference brightness and setting gamma, a reference gradation corresponding to the brightness of a gradation that image data represents is found in a reference gradation lookup table (LUT_GRY in FIG. 7). In addition, image data is converted to represent the reference gradation. A pixel unit is driven in response to the converted image data and the light-emitting control signal whose duty ratio has been adjusted in operation S5.

Figure 10A:
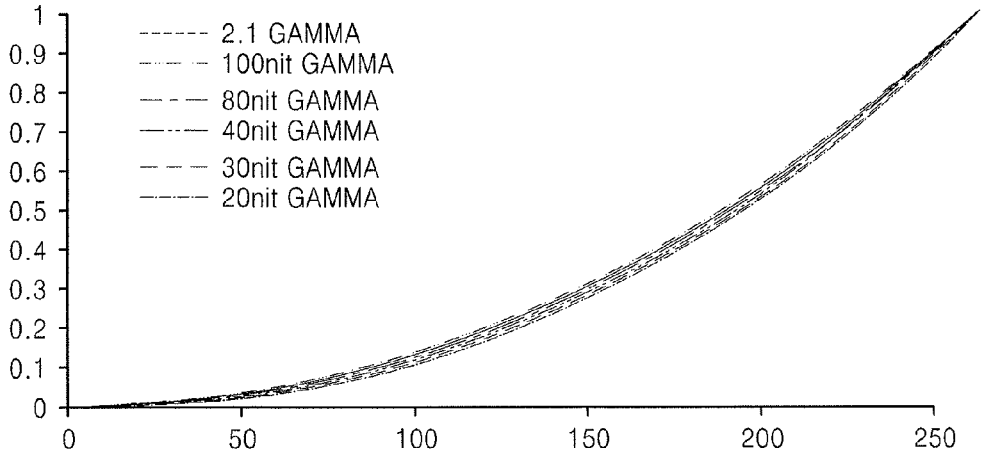
FIGS. 10A and 10B are views representing gamma curves according to brightness modes.
Figure 10B:
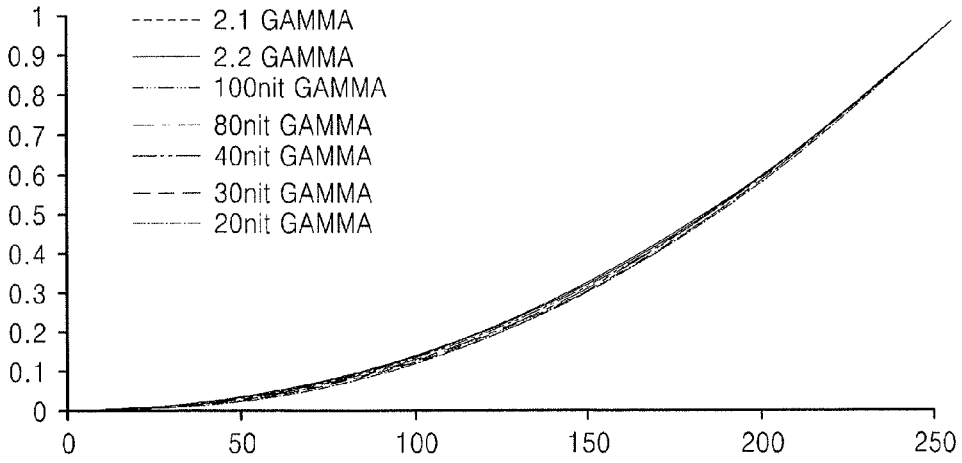

FIGS. 10A and 10B are views representing gamma curves according to brightness modes. FIG. 10A illustrates gamma curves by brightness modes when reference brightness is 110 nit and setting gamma is fixed to 2.1, and FIG. 10B illustrates gamma curves by brightness modes when setting gamma varies depending on brightness modes according to an embodiment. To make the comparison of gamma curves by brightness modes easy, the brightness at maximum gradation is converted to 1 and illustrated. As illustrated in FIG. 10A, if setting gamma is fixed, then as the brightness mode has lower brightness, namely as the off-period of a light-emitting control signal gets longer, the brightness of a middle gradation gets lower. Thus, gamma curves by brightness modes do not match one another. If setting gamma varies depending on the brightness modes according to a display device (100 in FIG. 1) and a method of driving a display device according to embodiments, then gamma curves by brightness modes are not significantly different but approximately similar to the gamma curve of gamma 2.2.

By way of summation and review, it may not be easy for the organic electroluminescence display devices to adjust their brightness because they do not have a separate light emitting unit, such as backlight, unlike liquid crystal display devices. In order to adjust the brightness of the organic electroluminescence display devices, it is possible to convert input data or adjust the turn-on periods of the organic light emitting diodes.

Embodiments relate to a display device and a method of driving the same that adjust the brightness of images displayed on a pixel unit according to a brightness mode. Embodiments also relate to providing a display device and a method of driving the same that may adjust brightness without fluctuating gamma.

It should be understood by those skilled in the art that although the present invention has been described with reference to embodiments illustrated in the accompanying drawings, they are just examples and various variations and equivalent other embodiments may be made. Thus, the truly protected scope of the present invention should be defined only by the following claims.

What is claimed is:

1. A display device, comprising:

a pixel unit including a plurality of pixels for displaying image having brightness adjusted by using image data having brightness adjusted according to a brightness mode and by adjusting light-emitting times of the pixels in response to light-emitting control signals; and a brightness controller that adjusts a duty ratio of the light-emitting control signals to control the light-emitting times of the pixels according to the brightness mode, and adjusts values of setting gamma to generate the image data having brightness adjusted according to the brightness mode such that values of measuring gamma of the image displayed on the pixels are constant regardless of the adjustment of the duty ratio of the light-emitting control signals according to the brightness mode, wherein the brightness mode includes first and second brightness modes, the first and second brightness modes having different maximum brightness from each other.

2. The device of claim 1, wherein the brightness controller sets reference brightness serving as reference for converting brightness, selects the duty ratio of the light-emitting control signals and the setting gamma according to the brightness mode, and converts the image data according to the reference brightness and the setting gamma.

3. The device of claim 1, wherein as the brightness mode has lower brightness, the brightness controller increases off-periods of the light-emitting control signals that turn off the plurality of pixels.

4. The device of claim 1, wherein the brightness controller varies the setting gamma according to the brightness mode or the duty ratio of the light-emitting control signals.

5. The device of claim 1, wherein, as the brightness mode has lower brightness, off-periods of the light-emitting control signals increase, and the brightness controller decreases the values of the setting gamma.

6. The device of claim 1, wherein the brightness controller includes:

a duty ratio setter that outputs light-emitting duty control signals that adjust the duty ratio of the light-emitting control signals;

a gamma setter that selects the setting gamma in response to the brightness mode or the light-emitting duty control signals; and a data converter that converts the image data according to the brightness mode.

7. The device of claim 6, wherein the gamma setter includes a brightness-gamma lookup table in which the values of the setting gamma are mapped according to brightness.

8. The device of claim 6, wherein the gamma setter includes a gamma function setter in which a gamma function is set to calculate the values of the setting gamma according to brightness.

9. The device of claim , wherein the data converter includes a reference gradation lookup table in which reference gradation by brightness is mapped on the basis of predetermined brightness and gamma, and converts the image data with reference to reference brightness serving as a reference for converting brightness and the reference gradation corresponding to brightness by gradation according to the setting gamma.

10. The device of claim 1, wherein the plurality of pixels include organic electroluminescence diodes.

11. The device of claim 1, wherein the setting gamma of the first brightness mode is different from that of the second brightness mode.

12. An organic electroluminescence display device, comprising:

a pixel unit that includes a plurality of pixels for displaying image having brightness adjusted by using image data having brightness adjusted according to a brightness mode and by adjusting light-emitting times of the pixels in response to light-emitting control signals;

a data driver that supplies data signals to the pixel unit;

a scan driver that supplies scan signals and light-emitting control signals to the pixel unit; and a timing controller that includes a brightness controller to adjust a duty ratio of the light-emitting control signals to control the light-emitting times of the pixel according to the brightness mode, and adjusts values of setting gamma to generate the image data having brightness adjusted according to the brightness mode and such that values of measuring gamma of the image displayed on the pixels are constant regardless of the adjustment of the duty ratio of the light-emitting control signals according to the brightness mode, the timing controller providing control signals to the data driver and the scan driver, wherein the brightness mode includes first and second brightness modes, the first and second brightness modes having different maximum brightness from each other.

13. The device of claim 12, wherein the brightness controller sets reference brightness and the duty ratio of the light-emitting control signals according to the brightness mode.

14. The device of claim 12, wherein the timing controller and the data driver are integrated on a single semiconductor chip.

15. A method of driving a display device for driving a pixel unit including a plurality of pixels for displaying image having brightness adjusted by using image data having brightness adjusted according to a brightness mode and by adjusting light-emitting times of the pixels in response to light-emitting control signals, the method comprising:

setting reference brightness adjusted according to the brightness mode;

adjusting a duty ratio of light-emitting control signals to control the light-emitting times of the pixel according to the brightness mode;

adjusting values of setting gamma to generate the image data having brightness adjusted according to the brightness mode or the duty ratio of the light-emitting control signals such that values of measuring gamma of the image displayed on the pixels are constant regardless of the adjustment of the duty ratio of the light-emitting control signals according to the brightness mode;

converting image data according to the reference brightness and the setting gamma; and driving the pixel unit in response to the converted image data and the light-emitting control signals, wherein the brightness mode includes first and second brightness modes, the first and second brightness modes having different maximum brightness from each other.

16. The method of claim 15, wherein adjusting the duty ratio of the light-emitting control signals includes setting light-emitting control signals to allow off-periods of the light-emitting control signals turning off the plurality of pixels to increase, as the brightness mode has lower brightness.

17. The method of claim 15, wherein the adjusting of the setting gamma includes allowing the values of the setting gamma to decrease, as the brightness mode has lower brightness or off-periods of the light-emitting control signals increase.

18. The method of claim 15, wherein adjusting the setting gamma includes setting the setting gamma with reference to a lookup table in which the values of setting gamma is mapped according to brightness considering the properties of the pixel unit.

19. The method of claim 15, wherein converting image data includes:

selecting reference gradation corresponding to the brightness mode and brightness by gradation according to the setting gamma with reference to a reference gradation lookup table in which reference gradation by brightness has been mapped on the basis of maximum brightness and given gamma; and converting the image data with reference to the selected reference gradation.

* * * * *